US007497788B2

(12) United States Patent
Imamoto et al.

(10) Patent No.: US 7,497,788 B2
(45) **Date of Patent: *Mar. 3, 2009**

(54) GOLF CLUB HEAD

(75) Inventors: Yasunori Imamoto, Tokyo (JP); Katsumi Iida, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/582,978

(22) Filed: Oct. 19, 2006

(65) Prior Publication Data

US 2007/0049414 A1 Mar. 1, 2007

Related U.S. Application Data

(62) Division of application No. 10/462,673, filed on Jun. 17, 2003, now Pat. No. 7,147,576.

(30) Foreign Application Priority Data

Jun. 19, 2002 (JP) ..... P2002-178798

(51) Int. Cl.
*A63B 53/04* (2006.01)

(52) U.S. Cl. ..... 473/335; 473/345; 473/349

(58) Field of Classification Search ..... 473/324–350
See application file for complete search history.

(56) References Cited

U.S. PATENT DOCUMENTS

| | | | |
|---|---|---|---|
| 3,652,094 | A | 3/1972 | Glover |
| 4,021,047 | A | 5/1977 | Mader |
| 4,432,549 | A | 2/1984 | Zebelean |
| 4,438,931 | A | 3/1984 | Motomiya |
| 5,205,560 | A | 4/1993 | Hoshi et al. |
| 5,255,913 | A | 10/1993 | Tsuchida |
| 5,547,427 | A | 8/1996 | Rigal et al. |
| 5,570,886 | A | 11/1996 | Rigal et al. |
| 5,624,331 | A | 4/1997 | Lo et al. |
| 5,669,827 | A | 9/1997 | Nagamoto |
| 5,766,095 | A | 6/1998 | Antonious |

(Continued)

FOREIGN PATENT DOCUMENTS

JP 4-89071 A 3/1992

(Continued)

OTHER PUBLICATIONS

Japanese Office Action dated Nov. 2, 2006 issued in JP Patent Application 2002-178798.

(Continued)

*Primary Examiner*—Sebastiano Passaniti
(74) *Attorney, Agent, or Firm*—Sughrue Mion, PLLC

(57) ABSTRACT

A hollow golf club head has a face portion, a sole portion, a side portion, a crown portion, and a hosel portion. A main portion of the crown portion is made of fiber reinforced plastic. At least the face portion and the front edge portion of the crown portion continuing to the face portion are made of metal. A circumferential edge portion of the crown portion made of fiber reinforced plastic is joined to the rear end surface and the internal surface of the metal front edge portion of the crown portion.

10 Claims, 4 Drawing Sheets

U.S. PATENT DOCUMENTS

| | | | | |
|---|---|---|---|---|
| 5,997,415 | A | 12/1999 | Wood | |
| 6,010,411 | A | 1/2000 | Reyes | |
| 6,089,992 | A | 7/2000 | Onuki et al. | |
| 6,162,130 | A | 12/2000 | Masumoto et al. | |
| 6,248,025 | B1 | 6/2001 | Murphy et al. | |
| 6,254,494 | B1 | 7/2001 | Hasebe et al. | |
| 6,354,962 | B1 | 3/2002 | Galloway et al. | |
| 6,354,963 | B1 | 3/2002 | Kodama et al. | |
| 6,371,868 | B1 | 4/2002 | Galloway et al. | |
| 6,381,828 | B1 | 5/2002 | Boyce et al. | |
| 6,406,378 | B1 | 6/2002 | Murphy et al. | |
| 6,435,977 | B1 | 8/2002 | Helmstetter et al. | |
| 6,435,978 | B1 | 8/2002 | Galloway et al. | |
| 6,440,008 | B2 | 8/2002 | Murphy et al. | |
| 6,440,011 | B1 | 8/2002 | Hocknell et al. | |
| 6,471,604 | B2 | 10/2002 | Hocknell et al. | |
| 6,491,592 | B2 | 12/2002 | Cackett et al. | |
| 6,524,194 | B2 | 2/2003 | McCabe | |
| 6,524,198 | B2 | 2/2003 | Takeda | |
| 6,527,650 | B2 | 3/2003 | Reyes et al. | |
| 6,575,845 | B2 | 6/2003 | Galloway et al. | |
| 6,582,321 | B2 | 6/2003 | Galloway et al. | |
| 6,582,323 | B2 | 6/2003 | Soracco et al. | |
| 6,602,149 | B1 | 8/2003 | Jacobson | |
| 6,607,452 | B2 | 8/2003 | Helmstetter et al. | |
| 6,620,056 | B2 | 9/2003 | Galloway et al. | |
| 6,623,378 | B2 | 9/2003 | Beach et al. | |
| 6,648,774 | B1 | 11/2003 | Lee | |
| 6,676,536 | B1 | 1/2004 | Jacobson | |
| 6,739,982 | B2 | 5/2004 | Murphy et al. | |
| 6,945,876 | B2 | 9/2005 | Nakahara et al. | |
| 6,969,326 | B2 * | 11/2005 | De Shiell et al. | 473/345 |
| 7,147,576 | B2 * | 12/2006 | Imamoto et al. | 473/334 |
| 2001/0029210 | A1 * | 10/2001 | Murphy et al. | 473/345 |
| 2001/0049310 | A1 | 12/2001 | Cheng et al. | |
| 2002/0160858 | A1 | 10/2002 | Lee | |
| 2003/0083151 | A1 | 5/2003 | Nakahara et al. | |
| 2003/0109328 | A1 * | 6/2003 | Chen | 473/342 |
| 2003/0125127 | A1 | 7/2003 | Nakahara et al. | |
| 2003/0134692 | A1 | 7/2003 | Nakahara et al. | |
| 2003/0134693 | A1 | 7/2003 | Nakahara et al. | |
| 2004/0005936 | A1 | 1/2004 | Imamoto et al. | |
| 2004/0116208 | A1 | 6/2004 | De Shiell et al. | |
| 2004/0266551 | A1 | 12/2004 | Noguchi et al. | |

FOREIGN PATENT DOCUMENTS

| | | | |
|---|---|---|---|
| JP | 05-068725 | A | 3/1993 |
| JP | 06-039941 | A | 2/1994 |
| JP | 7-406 | | 1/1995 |
| JP | 7-406 | U | 1/1995 |
| JP | 07-112041 | A | 5/1995 |
| JP | 07-112042 | A | 5/1995 |
| JP | 07-155410 | A | 6/1995 |
| JP | 08-024377 | A | 1/1996 |
| JP | 09-038250 | A | 2/1997 |
| JP | 09-187534 | A | 7/1997 |
| JP | 09-215786 | A | 8/1997 |
| JP | 09-322953 | A | 12/1997 |
| JP | 10-015119 | A | 1/1998 |
| JP | 11-319167 | A | 11/1999 |
| JP | 2000-024149 | A | 1/2000 |
| JP | 2000-33133 | A | 2/2000 |
| JP | 2000-167090 | A | 6/2000 |
| JP | 2001-062003 | A | 3/2001 |
| JP | 2001-087426 | A | 4/2001 |
| JP | 2001-149514 | A | 6/2001 |
| JP | 2001-309998 | A | 11/2001 |
| JP | 2001-321474 | A | 11/2001 |
| JP | 2001-340499 | A | 11/2001 |
| JP | 2002-000773 | A | 1/2002 |
| JP | 2002-011122 | A | 1/2002 |
| JP | 2002-224249 | A | 8/2002 |
| JP | 2003-062130 | | 3/2003 |
| JP | 2003-144590 | A | 5/2003 |
| JP | 2003-205055 | A | 7/2003 |
| JP | 2003-320060 | A | 11/2003 |
| JP | 2004-016654 | A | 1/2004 |
| JP | 2004-065810 | A | 3/2004 |
| JP | 2004-180759 | | 7/2004 |
| WO | WO 2004/052472 | | 6/2004 |

OTHER PUBLICATIONS

Japanese Office Action dated Jan. 22, 2007 issued in JP Patent Application 2002-178798.

Japanese Office Action dated May 8, 2007 issued in JP Patent Application 2002-178798.

* cited by examiner

GOLF CLUB HEAD

The present application is a divisional application of U.S. application Ser. No. 10/462,673, filed Jun. 17, 2003, now U.S. Pat. No. 7,147,576 which disclosure relates to the subject matter contained in Japanese Patent Application No. 2002-178798 filed on Jun. 19, 2002, which is incorporated herein by reference in its entirety.

BACKGROUND OF THE INVENTION

1. Field of the Invention

The present invention relates to a hollow golf club head, and particularly relates to a golf club head having a shape of a wood type or a shape approximating the shape of the wood type.

2. Description of the Related Art

Hollow metal heads are used broadly as wood type golf club heads for drivers or fairway woods. Generally, a wood type hollow golf club head has a face portion for hitting a ball, a crown portion forming the top surface portion of the golf club head, a sole portion forming the bottom surface portion of the golf club head, a side portion forming the toe-side, rear-side and heel-side side surface portions of the golf club head, and a hosel portion. A shaft is inserted into the hosel portion, and fixed thereto by a bonding agent or the like. Incidentally, recently, many golf club heads called utility clubs are commercially available. Various golf club heads similar to the wood type golf club head (that is, having a face portion, a sole portion, a side portion, a crown portion and a hosel portion) are commercially available as a kind of utility golf club head.

An aluminum alloy, stainless steel or a titanium alloy is used as the metal forming such a hollow golf club head. In recent years, particularly a titanium alloy is used broadly.

When a hollow golf club head is increased in volume, its sweet spot can be expanded. In order to prevent the golf club head from increasing in weight with the increase of the volume thereof, it is considered that fiber reinforced plastic whose specific gravity is smaller than that of the metal is adopted as the constituent material of the golf club head. In this case, the face surface for hitting a ball has to be made of metal in order to secure strength. Therefore, the portion other than the face portion is made of fiber reinforced plastic (FRP).

JP-A-2001-340499 discloses a golf club head in which a crown portion and toe-side and heel-side side portions are made of carbon fiber reinforced thermoplastic (CFRP).

In the golf club head according to JP-A-2001-340499, in which a crown portion and toe-side and heel-side side portions are made of carbon fiber reinforced thermoplastic resin (CFRP), the crown portion and the side portions made of CFRP butt against the circumferential edge of a face portion simply. Markedly great stress is applied to the joint portion between the crown portion and the face portion and the joint portions between the side portions and the face portion when a ball is hit. Particularly, markedly great stress is applied to the joint portion between the face portion and the crown portion. In the golf club head according to JP-A-2001-340499, in which the crown portion and the side portions made of CFRP are butt-joined to the circumferential edge of the face portion simply, there is a possibility that repeated use may result in peeling in the joint portions.

SUMMARY OF THE INVENTION

It is an object of the invention to provide a golf club head in which the joint between a crown portion made of fiber reinforced plastic and a face portion made of metal is firm so that the durability is excellent.

According to an aspect of the invention, a hollow golf club head includes a face portion, a sole portion, a side portion, a crown portion, and a hosel portion. A first part of the crown portion is made of fiber reinforced plastic. At least the face portion and a second part of the crown portion continued to the face portion are made of metal. The first part of the crown portion is joined to a rear end surface and an internal surface of the second part of the crown portion.

According to a second aspect of the invention, in the golf club head of the first aspect, a front edge portion of the side portion and a front edge portion of the sole portion are made of metal and continue to the face portion. A portion a center of the sole portion in a toe/heel-direction is made of metal continuing to the front edge portion of the sole portion. The center portion of the sole portion extends to a rear surface portion of the golf club head.

According to a third aspect, in the golf club head of the second aspect, a portion made of fiber reinforced plastic continuing to the first part of the crown portion forms a rear portion of the side portion and opposite side portions of a rear portion of the sole portion in a toe/heel-direction.

According to a fourth aspect of the invention, in the golf club head of any one of the first to third aspects, the first part of the crown portion is lower in rigidity in a front/rear direction of the golf club head than that in a toe/heel direction of the golf club head.

According to a fifth aspect of the invention, A hollow golf club head includes a first portion and a second portion. The first portion is made of fiber reinforced plastic and includes a first part of a crown portion. The second portion is made of metal and includes a face portion and a second part of the crown portion continuing to the face portion. The first portion is joined to an end surface and an internal surface of the second portion.

DETAILED DESCRIPTION OF THE PREFERRED EMBODIMENTS

Figure 1:
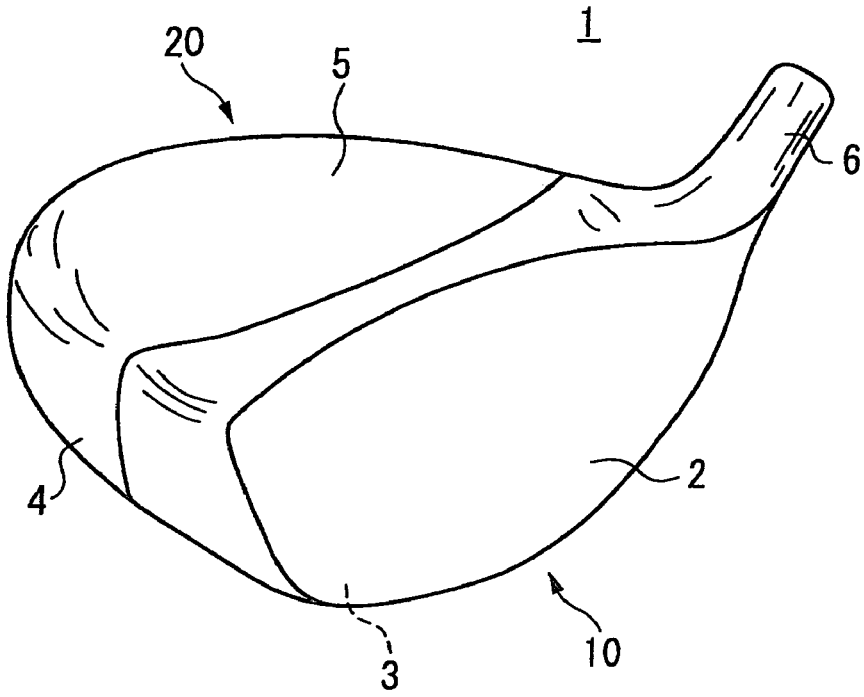
FIG. 1 is a perspective view of a golf club head according to an embodiment of the invention.
Figure 2:
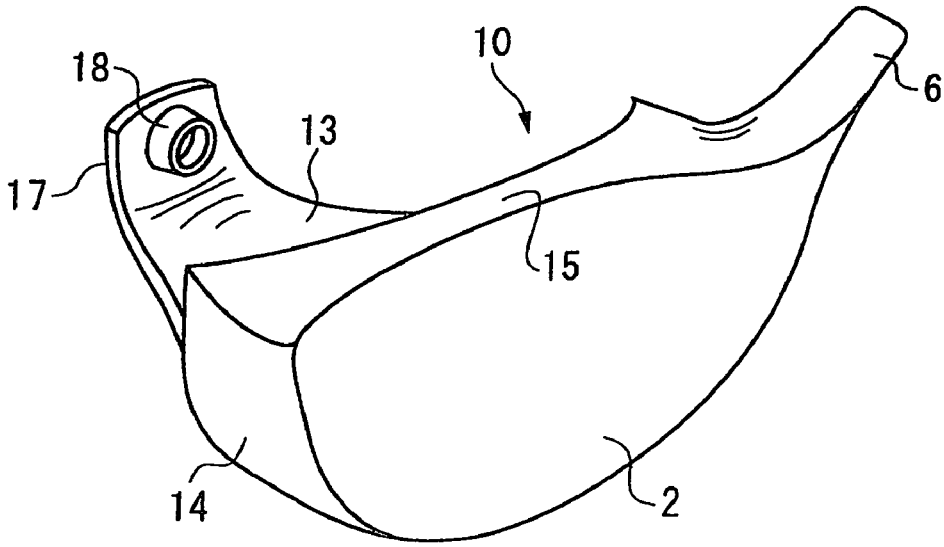
FIG. 2 is a perspective view of a metal body of the golf club head in FIG. 1, viewed from its front.
Figure 3:
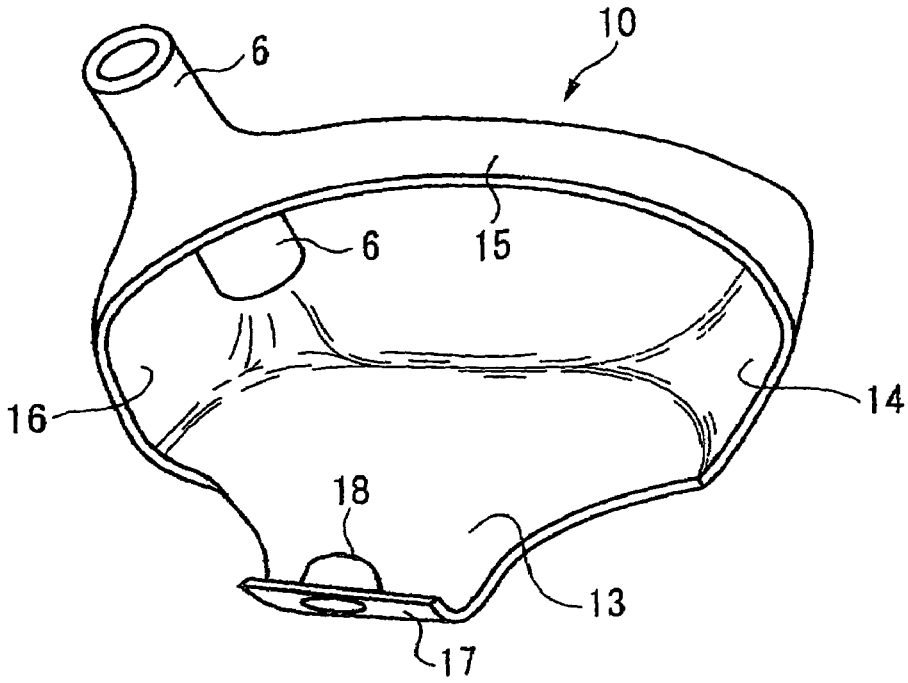
FIG. 3 is a perspective view of the metal body of the golf club head in FIG. 1, viewed from its rear.
Figure 4:
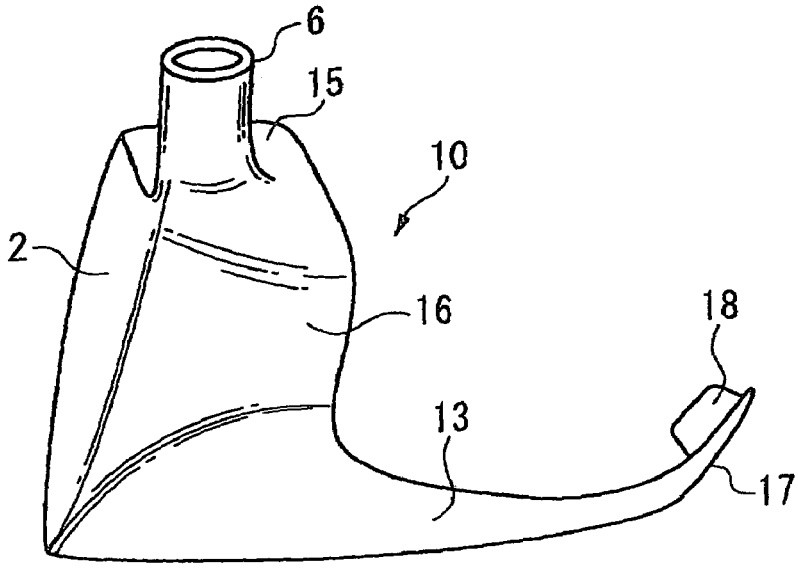
FIG. 4 is a side view of the metal body of the golf club head in FIG. 1, viewed from its heel side.
Figure 5:
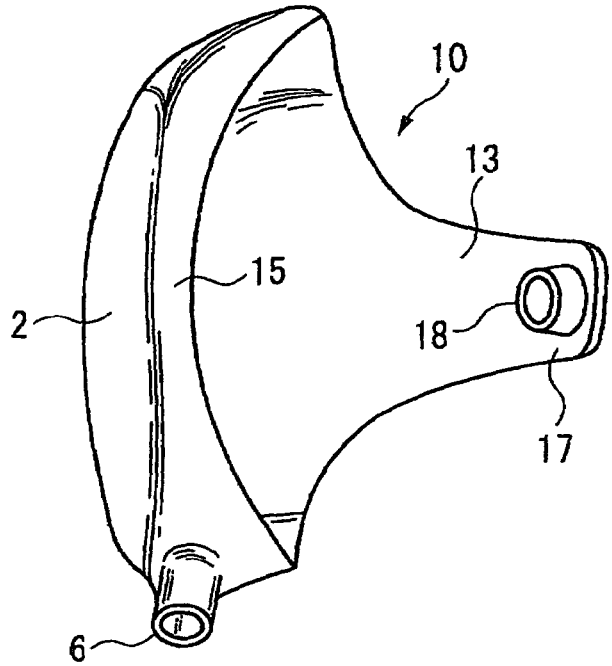
FIG. 5 is a plan view of the metal body of the golf club head in FIG. 1.
Figure 6A:
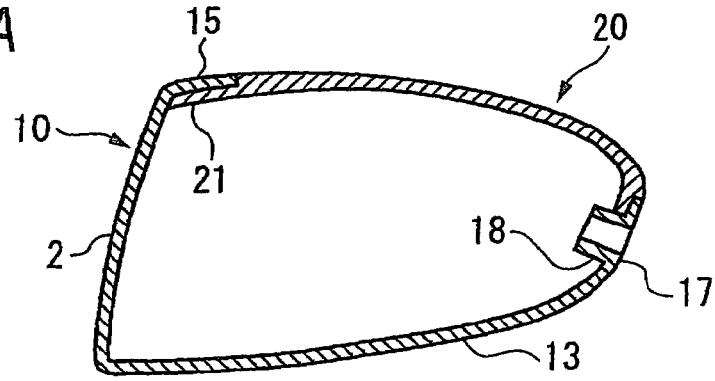
FIG. 6A is a longitudinal sectional view of the golf club head in FIG. 1 in a front/rear direction.
Figure 6B:
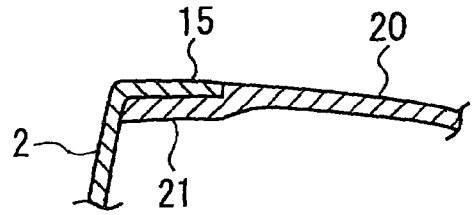
FIG. 6B is a partially enlarged view of FIG. 6A.

Description will be made below on an embodiment of the invention with reference to the drawings. FIG. 1 is a perspective view of a golf club head according to an embodiment of the invention. FIG. 2 is a perspective view of a metal body of the golf club head, viewed from its front. FIG. 3 is a perspective view of the metal body, viewed from its rear. FIG. 4 is a side view of the metal body, viewed from its heel side. FIG. 5 is a plan view of the metal body. FIG. 6A is a longitudinal sectional view of the golf club head in a front/rear direction. FIG. 6B is a partially enlarged view of FIG. 6A.

This golf club head 1 is a wood type hollow golf club head having a face portion 2, a sole portion 3, a side portion 4, a crown portion 5 and a hosel portion 6. The golf club head 1 is constituted by a metal body 10 and a fiber reinforced plastic body (hereinafter referred to as "FRP body") 20.

The metal body 10 includes the face portion 2, a metal sole portion 13, a metal side portion (toe) 14, a metal crown portion 15, a metal side portion (heel) 16, a metal back portion 17, an annular portion 18 and the hosel portion 6. The annular portion 18 is provided in the metal back portion 17.

The face portion 2 is a surface for hitting a ball, and provided with grooves (score lines) though not shown. The sole portion 3 forms the bottom surface portion of the golf club head. The side portion 4 forms the toe-side, heel-side and rear-surface-side side surface portions of the golf club head. The crown portion 5 forms the top surface portion of the golf club head. A shaft is inserted into the hosel portion 6 and fixedly attached thereto by a bonding agent.

The metal body 10 forms the face portion 2, the front edge portion of the crown portion 5, the front edge portion of the side portion 4, the front edge portion and center portion of the sole portion 3 in the left/right direction (heel/toe direction), and the rear surface portion of the golf club head.

The metal crown portion 15 forming the front edge portion of the crown portion 5 continues to the metal side portion (toe) 14 and the metal side portion (heel) 16. The metal side portion (toe) 14 and the metal side portion (heel) 16 continue to the metal sole portion 13, respectively. The metal side portions 14 and 16 and the metal sole portion 13 continue to the face portion 2.

The front portion of the metal sole portion 13 has a maximum width ranging from the toe side of the golf club head to the heel side thereof. The width of the metal sole portion 13 between its front portion and its rear portion is reduced gradually as the location approaches to the rear portion. The rear portion of the metal sole portion 13 is disposed in the center portion of the golf club head in the heel/toe-direction. The metal back portion 17 continues to the rear end of the metal sole portion 13. The metal back portion 17 rises obliquely backward from the metal sole portion 13. The annular portion 18 is formed integrally with the internal surface of the metal back portion 17. An opening is provided to penetrate the annular portion 18 and the metal back portion 17, and a female thread (not shown) is provided in the inner circumferential surface of the opening.

It is preferable that the metal body 10 is formed integrally by casting. Incidentally, the metal body may be a junction body formed out of a plurality of parts, or the like.

The FRP body 20 forms the other portion of the external surface of the golf club head 1. That is, the FRP body 20 forms the rear half portion of the crown portion 5, the rear half portion (excluding the metal back portion) of the side portion 4, and a portion of the sole portion 3 other than the metal sole portion 13.

As shown in a magnified form in FIGS. 6A and 6B, the FRP body 20 is in tight contact with the end surfaces of the metal crown portion 15, the metal side portions (both toe and heel) 14 and 16, and the metal sole portion 13, while the FRP body 20 is in tight contact with the internal surfaces of the edges of these portions so as to overlap the internal surfaces of the edges. Particularly, in the metal crown portion 15, the FRP body 20 reaches the back surface of the face portion 2 as shown in FIG. 6B. That is, the FRP body 20 is in tight contact with the internal surface of the metal crown portion 15 so as to overlap the whole of the internal surface of the metal crown portion 15.

To form the FRP body 20 and integrate the FRP body 20 with the metal body 10, the metal body 10 whose internal surface has been subjected to primer treatment in accordance with necessity is disposed in a mold shaped correspondingly to the outer shape of the golf club head. Next, a prepreg sheet laminate (uncured resin-fiber composite material sheet) is disposed along the internal surface of the mold and the internal surface of the edge of the metal body 10. Incidentally, this laminate may be formed correspondingly to the internal surface of the mold in advance. After that, the resin is heated and cured while gas pressure is applied to the inside through the opening of the annular portion 18. At this time, a resin bag of nylon or the like may be disposed inside the golf club head in advance. In this condition, gas is supplied into the bag so as to inflate the bag. Thus, pressure is put on the prepreg sheet so as to bring the prepreg sheet into tight contact with the internal surface of the mold.

In this manner, the FRP body 20 is molded while the circumferential edge portion 21 of the FRP body 20 is brought into tight contact with the end surface and the edge portion of the metal body 10, as shown in FIGS. 6A and 6B. The metal body 10 is formed of the metal side portion 14 extending backward from the face portion, and the metal crown portion 15. Therefore, the resin bag inflated by supplying the gas presses the metal body 10 against an inner surface of the mold so that the metal body 10 is in a stable state. Especially, it is preferred that the gas is supplied to the resin bag from the back portion. This is because the face portion is pressed from behind. After completion of the molding, the golf club head is released from the mold, and a vibration absorption layer or a ball-hitting sound adjustment layer is formed on the internal surface of the golf club head in accordance with necessity. For example, when a pressure-sensitive adhesive agent composed of polyisobutylene or the like is formed into a layer, the golf club head is prevented from self-sounding.

A stopper-like piece (not shown in FIGS. 1-5, 6A and 6B) is screwed into the opening of the metal back portion 17. A female thread for this screwing may be provided in the metal body 10 in advance or after the mold release. After that, grinding and painting is carried out on the external surface of the golf club head in accordance with necessity. Thus, a golf club head product is formed.

It is preferable that the stopper-like piece is made of a high specific gravity material such as tungsten in order to increase the center-of-gravity depth of the golf club head.

The golf club head configured thus is light in weight because its rear half portion is chiefly formed of an FRP body. Thus, the golf club head can be increased in size.

In addition, since the FRP body 20 is joined in tight contact with the metal body 10 so as to overlap the internal surface of the edge of the metal body 10, the joint between the metal body 10 and the FRP 20 is firm so that the durability is excellent. Incidentally, it is preferable that the average value of the front/rear direction (face/back direction) width of the metal crown portion 15 and the metal side portion 14 is 2-20 mm, particularly about 5-18 mm.

In the golf club head according to the embodiment, the metal sole portion 13, the metal side portions 14 and 16 and the metal crown portion 15 are disposed all around the circumference of the face portion 2. Accordingly, the rigidity is high in the circumferential edge portion of the face portion 2. Thus, when the face portion 2 is made thin, the repulsion property at the time of hitting a ball can be enhanced to lengthen a carry.

In the golf club head, the front edge portion of the sole portion 3 is constituted by the metal sole portion 13. Accordingly, even when the front edge portion of the sole portion 3 hits the ground (with so-called a fat shot) at the time of a swing, there is no fear that the front edge portion of the sole portion 13 is damaged.

In the golf club head, the metal sole portion 13 extends in the center of the sole portion 3 in the front/rear direction. Accordingly, the center of gravity of the golf club head can be lowered to make it easy to hit a ball high. In addition, since the metal sole portion 13 is allowed to extend to the rear, the center of gravity of the golf club head is so deep that the sweet area becomes wide. Further, the annular portion 18 is disposed in the metal back portion 17 continuing to the rearmost end of the metal sole portion 13, and a stopper-like piece made of a high specific gravity material is screwed down into the annular portion 18. Thus, the center-of-gravity depth is made deeper.

In this embodiment, a part of the hosel portion 6 is disposed inside the golf club head as shown in FIG. 3. Accordingly, the center of gravity can be lowered.

In addition, when a part of the hosel portion 6 is disposed inside the golf club head as described above, the twisting moment applied to the shaft at the time of hitting a ball is reduced so that the lateral deviation of the hit ball is reduced. Incidentally, when the protrusion length of the hosel portion 6 from the external surface of the golf club head is reduced, the external appearance of the golf club head becomes good.

It is desirable that the length with which the hosel portion 6 is disposed inside the golf club head is 10-50 mm, particularly 20-50 mm, more particularly 35-45 mm.

Examples of the metal for forming the metal body 10 include titanium, titanium alloys, and aluminum alloys such as A201, all of which are light in weight. Of them, titanium alloys such as 6Al-4V—Ti are preferred. It is preferable that the thickness of the face portion 2 is about 2-5 mm, particularly about 2-3 mm in the case of a titanium alloy. Incidentally, the metal body may be made of stainless steel.

In the embodiment of the invention, the orientation direction of reinforcing fiber in the crown portion of the FRP body 20 may be controlled to make the rigidity in the front/rear direction (face/back direction) lower than the rigidity in the toe/heel direction (left/right direction). In this manner, the bending quantity of the crown portion at the time of hitting a ball increases so that the launch angle of the ball becomes high. As a result, the carry (flight distance) of the hit ball lengthens.

Figure 7A:
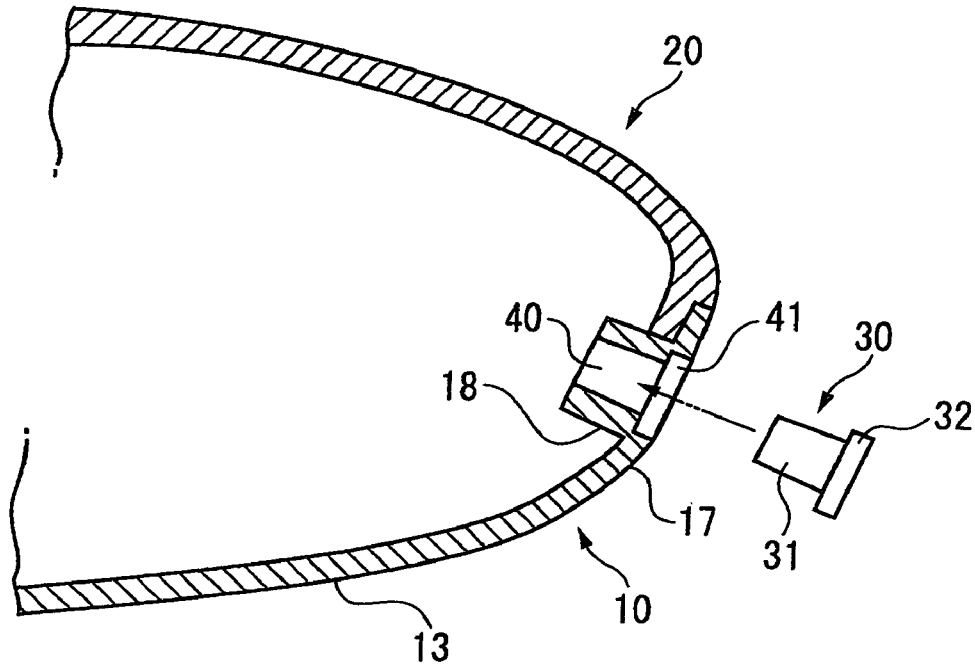
FIGS. 7A and 7B are longitudinal sectional views of a rear portion of a golf club head according to another embodiment of the invention, FIG. 7A showing the state before a stopper-like piece is mounted, FIG. 7B showing the state after the stopper-like piece has been mounted.
Figure 7B:
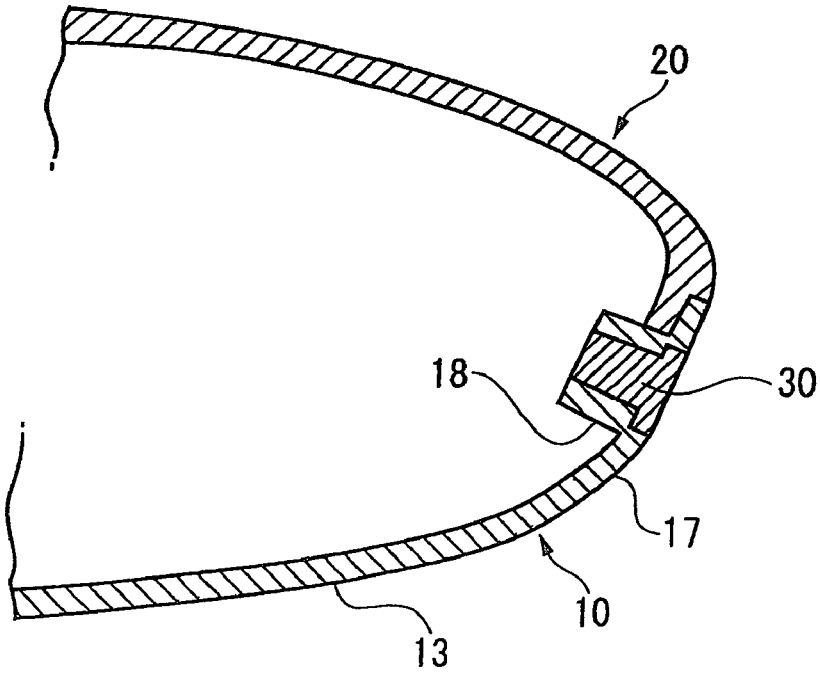

In the embodiment of the invention, a stopper-like piece 30 may be fixedly attached to the opening 40 of the annular portion 18 by brazing or welding (e.g. laser welding or TIG welding) as shown in FIGS. 7A and 7B. This stopper-like piece 30 has a columnar portion 31 and a flange portion 32 provided at the rear end of the columnar portion 31. The opening 40 of the annular portion 18 has a step portion 41 in its entrance portion. The flange portion 32 is engaged with the step portion 41.

When the metal body 10 is made of stainless steel, a tungsten-nickel-iron (W—Ni—Fe) alloy having a large specific gravity of about 10-12 can be used for the stopper-like piece 30. The following recipe is suitable for the composition of the alloy.

W: 28-32 wt %
Fe: 45-49 wt %
Ni: 15-17 wt %
Cu: 1-2 wt %

This alloy composition can be cast. The alloy composition is so rich in Fe that it is superior in weldability with stainless steel. Thus, the alloy composition can be welded easily even by TIG welding that is a general welding method.

Either cross fiber prepreg or unidirectional fiber prepreg may be used as the prepreg for forming the FRP body 20. When SMC (sheet molding compound) prepreg is use as the prepreg, it is possible to form a thin FRP body 20 easily.

It is preferable that about 3-8 sheets of prepreg are used as a laminate.

As the fiber in the prepreg, carbon fiber or the like having an elastic modulus of about $20\times10^3$-$30\times10^3$ kg/mm$^2$ is suitable, but the fiber in the prepreg is not limited thereto.

As described previously, it is preferable that the orientation of the fiber is controlled to make the elastic modulus in the front/rear direction lower than the elastic modulus in the toe/heel direction in the crown portion. For example, cross fiber prepreg and unidirectional fiber prepreg are laminated alternately, and the fiber orientation direction of the unidirectional fiber prepreg is set in the toe/heel direction.

Thermosetting resin such as epoxy resin can be used as the resin of the FRP body 20. Incidentally, a small amount of thermoplastic resin may be mixed into the thermosetting resin. This results in improvement in vibration absorbing property.

It is preferable that the thickness of the FRP body is about 1-3 mm. Particularly, it is preferable that the thickness of the crown portion is about 1-2 mm, particulary 1-1.5 mm, for example, about 1.3 mm.

The invention is suitable to be applied to a large-size head having a volume not smaller than 300 cm$^3$, particularly not smaller than 350 cm$^3$, for example, 350-400 cm$^3$. There is no upper limit on the head size based on the rule. A super large size head having a volume of about 600 cm$^3$ can be manufactured technically. It is preferable that the weight of the golf club head is 160-200 g, particularly about 180-190 g.

As described above, according to the invention, a golf club head light in weight and large in size is provided because fiber reinforced plastic is partially used in the golf club head. This golf club head is high in joint strength between its fiber reinforced plastic portion and its metal portion, and also superior in durability.

What is claimed is:

1. A hollow golf club head comprising:

a face portion;

a sole portion;

a side portion;

a crown portion; and a hosel portion, wherein a first part of the crown portion is made of fiber reinforced plastic;

wherein at least the face portion and a second part of the crown portion continued to the face portion are made of metal;

wherein the first part of the crown portion is joined to a rear end surface and to an internal surface of the second part of the crown portion;

wherein an orientation direction of reinforcing fiber in the crown portion is controlled such that a rigidity in a front/rear direction is lower than a rigidity in a toe/heel direction; and the orientation of the fiber is controlled to make the elastic modulus in the front/rear direction lower than the elastic modulus in the toe/heel direction in the crown portion.

2. The golf club head according to claim 1, wherein the fiber reinforced plastic is made of thermosetting resin.

3. The golf club head according to claim 2, wherein the fiber reinforced plastic includes a small amount of thermoplastic resin.

4. The golf club head according to claim 1 further comprising a back portion that has a female thread to which a stopper piece is attached, wherein the stopper piece is made of a high specific gravity material.

5. The golf club head according to claim 1 further comprising a back portion that extends to slant upward from the rear end of the sole portion.

6. The golf club head according to claim 5, wherein the back portion extends to an intermediate position between a bottom of the sole portion and a lowermost part of the crown portion.

7. The golf club head according to claim 1, wherein cross fiber prepreg and unidirectional fiber prepreg are laminated alternately, and the orientation direction of fiber in the unidirectional flow prepeg is substantially in parallel to the toe/heel direction.

8. A hollow golf club head comprising:

a face portion;

a sole portion;

a side portion;

a crown portion; and a hosel portion, wherein a first part of the crown portion is made of fiber reinforced plastic;

wherein at least the face portion and a second part of the crown portion continued to the face portion are made of metal;

wherein the first part of the crown portion is joined to a rear end surface and to an internal surface of the second part of the crown portion; and wherein an orientation direction of reinforcing fiber in the crown portion is controlled such that an elastic modulus in a front/rear direction is lower than an elastic modulus in a toe/heel direction; and wherein cross fiber prepreg and unidirectional fiber prepreg are laminated alternately, and the orientation direction of fiber in the unidirectional flow prepreg is substantially in parallel to the toe/heel direction.

9. The golf club head according to claim 8, wherein the thickness of the first part of the crown portion is 1 to 3 mm.

10. The golf club head according to claim 8, wherein 3 to 8 sheets of prepreg are laminated.

* * * * *